US009955827B2

(12) United States Patent
Morris

(10) Patent No.: US 9,955,827 B2
(45) Date of Patent: May 1, 2018

(54) MULTIPLE ROLL TISSUE HOLDER

(71) Applicant: Kory Tadj Morris, Raeford, NC (US)

(72) Inventor: Kory Tadj Morris, Raeford, NC (US)

( * ) Notice: Subject to any disclaimer, the term of this patent is extended or adjusted under 35 U.S.C. 154(b) by 538 days.

(21) Appl. No.: 14/615,530

(22) Filed: Feb. 6, 2015

(65) Prior Publication Data

US 2016/0227969 A1 Aug. 11, 2016

(51) Int. Cl.
*A47K 10/22* (2006.01)
*A47K 10/38* (2006.01)
*A47K 10/32* (2006.01)

(52) U.S. Cl.
CPC ..... *A47K 10/22* (2013.01); *A47K 10/38* (2013.01); *A47K 10/3836* (2013.01); *A47K 2010/3253* (2013.01)

(58) Field of Classification Search
CPC ..... A47K 2010/3253; A47K 10/3836; A47K 10/38; A47K 10/22; A47L 2010/3253
See application file for complete search history.

(56) References Cited

U.S. PATENT DOCUMENTS 2,025,732 A * 12/1935 Dodelin ..... A47K 10/3836 242/560
2,632,606 A * 3/1953 Krueger ..... A47K 10/3836 242/422.4
3,824,953 A * 7/1974 Boone ..... A47K 10/32 118/506
4,381,083 A * 4/1983 Tsunetsugu ..... A47K 10/38 242/422.5
4,824,038 A * 4/1989 Chandler ..... A47K 10/3836 242/598.2
2004/0000612 A1* 1/2004 Young ..... A47K 10/3836 242/597.8
2004/0075015 A1* 4/2004 Cain ..... A47K 10/38 242/595
2006/0261211 A1* 11/2006 Hass ..... A47K 10/405 242/598.1
2012/0111987 A1* 5/2012 Phelps ..... A47K 10/40 242/560
2012/0256036 A1* 10/2012 Osborne ..... A47K 10/38 242/560
2013/0320130 A1* 12/2013 Osborne, Jr. ..... A47K 10/38 242/561
2014/0034773 A1* 2/2014 Rote; Patrick Dane ..... A47K 10/38 242/595.1

(Continued)

*Primary Examiner* — William E Dondero
*Assistant Examiner* — Mark K Buse
(74) *Attorney, Agent, or Firm* — Jerry D Haynes

(57) ABSTRACT

A multiple roll toilet tissue holder that includes: a first mounting arm; a second mounting arm; a first mounting slot extending from the first mounting arm; a second mounting slot extending from the second mounting arm; a first rod extending from the first mounting arm at a 90 degree angle; a second rod extending from the second mounting arm at a 90 degree angle; and a third rod in between the first mounting arm and second mounting arm, where the third rod is parallel and aligned with the first rod and second rod. The multiple roll toilet tissue holder may further include a magnetic portion at the center of the third rod, wherein the magnetic portion enables a division of the third rod and tissue holder into two halves. In one particular embodiment, the first rod and second rod are curved to help secure a toilet tissue roll in place.

7 Claims, 1 Drawing Sheet

(56) References Cited

U.S. PATENT DOCUMENTS

| | | | | |
|---|---|---|---|---|
| 2014/0158811 | A1* | 6/2014 | Cattacin | A47K 10/38<br>242/596.4 |
| 2015/0190018 | A1* | 7/2015 | Pherson | A47K 10/16<br>242/590 |

* cited by examiner

MULTIPLE ROLL TISSUE HOLDER

BACKGROUND OF THE INVENTION

1. Field of Invention

The present invention is a utensil that is used to hold multiple rolls of toilet tissue.

2. Description of Related Art

Presently a typical toilet tissue dispenser in a residential home provides a single roll of toilet paper for use with a user. This single toilet paper dispenser is usually mounted on a wall near the toilet of the bathroom. Further there are pedestals that are available that hold a single toilet paper roll for use in the toilet. Most bathrooms are equipped with this single toilet tissue roll near the toilet for use. One drawback to the single tissue roll holder is that once the roll is empty a replacement must be nearby to replace the empty toilet tissue roll. Typically additional storage devices are placed near the toilet or stored in the bathroom that store toilet tissue rolls for use. Most times these additional toilet tissue rolls may not be nearby or convenient for the next user of the toilet. As a consequence it would be advantageous to have a toilet roll holder that provided multiple rolls of toilet tissue for use in a residential setting. This multiple toilet tissue roll holder therefore could alleviate the necessity for frequently replacing the toilet roll in certain households or at certain times where there is heavy usage of the toilet.

SUMMARY OF THE INVENTION

The present invention relates to a multiple roll toilet tissue holder comprising: a first mounting arm; a second mounting arm; a first mounting slot extending from the first mounting arm; a second mounting slot extending from the second mounting arm; a first rod extending from the first mounting arm at a 90 degree angle; a second rod extending from the second mounting arm at a 90 degree angle; and a third rod in between the first mounting arm and second mounting arm, where the third rod is parallel and aligned with the first rod and second rod. The multiple roll toilet tissue holder may further include a magnetic portion at the center of the third rod, wherein the magnetic portion enables a division of the third rod and tissue holder into two halves. In one particular embodiment, the first rod and second rod are curved to help secure a toilet tissue roll in place.

DETAILED DESCRIPTION

The present invention relates to a multiple roll toilet tissue holder. The toilet tissue holder according to the present invention is able to hold multiple rolls of toilet tissue for use. This tissue holder according to the present invention is implemented through attachment to a conventional toilet tissue roll dispenser through the use of mounting slots. The mounting slots are placed in alignment with an existing toilet tissue dispenser. The conventional single toilet tissue holder includes a spool that receives a roll of toilet tissue. The present invention has mounting slots that slide onto the spool of the existing toilet tissue holder. Each mounting slot extends from a mounting arm. Extending at a 90-degree angle from each mounting arm is a tissue rod. Each respective tissue rod is curved to receive and maintain a roll of tissue on each rod. The tissue holder according to the present invention also separates into two pieces along a center rod of the tissue holder. The center rod of the tissue holder includes a magnetic portion that retains the two halves of the tissue holder in a complete position. When in this position the tissue holder is mounted at one end with the mounting slots onto a existing tissue holder and at a opposing end are provided with suction cups that enable the attachment of the tissue holder onto the wall of the bathroom where installed. The center rod, which includes the magnetic portion, is also capable of retaining a single roll of toilet tissue. The present invention therefore provides three additional rolls of tissue that are readily available for use. An alternative embodiment of the tissue holder may include a backplate so that the tissue holder is mounted onto the wall through the use of the backplate.

Figure 1:
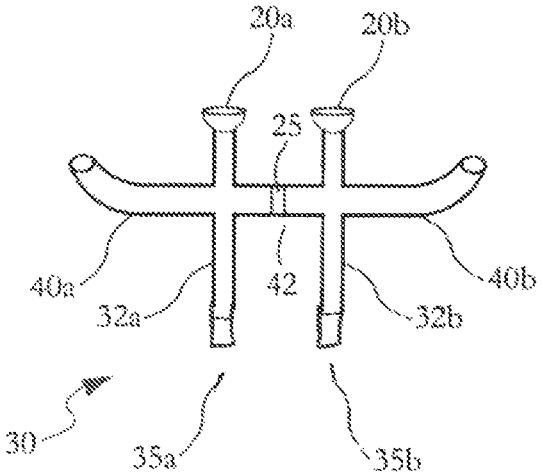
FIG. 1 depicts a perspective view of a multiple roll toilet tissue holder in accordance with the present invention.

In reference to FIG. 1, a toilet tissue holder 100 is depicted in FIG. 1. This tissue holder 100 includes a first mounting slot 35*a* and a second mounting slot 35*b*. These slots are adjoined onto an existing spool for a toilet roll tissue holder. As is well known toilet tissue comes on a roll with an opening that is inserted into an existing toilet tissue holder that includes a spool to receive the toilet tissue roll. Extending from the mounting slot 35*a*, 35*b* are arms 32*a*, 32*b*. Each arm 32*a*, 32*b* includes a rod that extends at a 90-degree angle from the mounting arm. The first rod 40*a* extends outwardly from the 32*a*. The second rod 40*b* extends from the 32*b*. Between the 32*a*, 32*b* is a third rod 42. This third rod 42 includes a magnetic portion 25. The magnetic portion 25 allows for the separation of the tissue holder 100 into two halves. These two matching halves adjoin when fully assembled. At the opposite end of each mounting arm 32*a*, 32*b* is a suction cup 20*a*, and 20*b* respectively. The suction cup 20*a*, 20*b* allow for the mounting of the tissue holder 100 onto a wall at the opposite end of each respective mounting arm 32*a*, 32*b*.

During use additional toilet tissue rolls may be placed upon the third rod 42 between the respective mounting arms 32*a*, 32*b*. Additional rolls of toilet paper may be placed on each rod 40*a*, 40*b*. This configuration therefore allows for multiple rolls of toilet tissue to be conveniently placed near an existing toilet paper holder.

Figure 2:
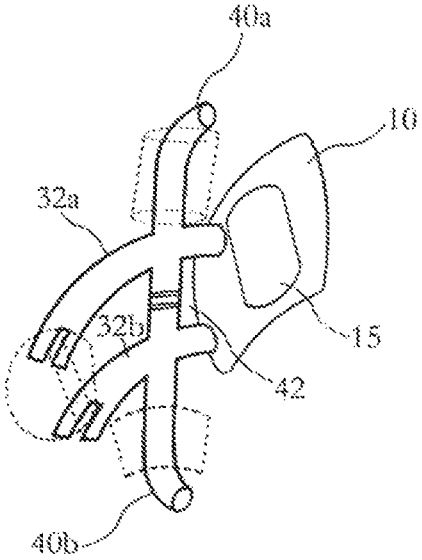
FIG. 2 depicts a use of the multiple roll toilet tissue holder with a backplate.
Figure 3:
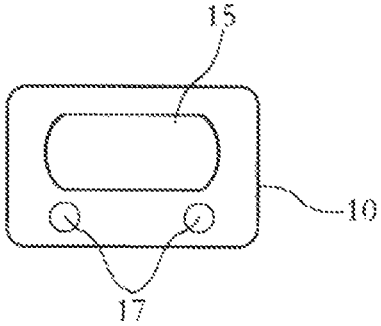
FIG. 3 depicts a backplate used in conjunction with the multiple roll toilet tissue holder.

FIG. 2 depicts an alternative embodiment of the tissue holder 100 in accordance with the present invention. The tissue holder 100 is attached to a mounting plate 10. The mounting plate 10 includes a decorative face plate 15. This mounting plate 10 enables the insertion of the mounting arms 32*a*, 32*b* to provide for a more aesthetic mounting configuration of the tissue holder 100. Further, FIG. 3 provides a complete view of the mounting plate 10 in accordance with the present invention. As can be seen in FIG. 3, the mounting plate 10 includes two openings 17 that allow for the insertion of the mounting arms 32*a*, 32*b* during use. The face plate 15 on the mounting plate 10 may be used for the display of an aesthetic logo or sticker or any other type of decorative features for the toilet tissue holder in accordance with the present invention. The instant invention has been shown and described in what it considers to be the most practical and preferred embodiments. It is recognized, however, that departures may be made there from within the scope of the invention and that obvious modifications will occur to a person skilled in the art.

What is claimed is:

1. A multiple roll toilet tissue holder comprising:

a. a first mounting arm;

b. a second mounting arm;

c. a first mounting slot extending from the first mounting arm;

d. a second mounting slot extending from the second mounting arm, wherein the first mounting slot and second mounting slot are adapted to receive a first roll of tissue paper;

e. a first rod extending from the first mounting arm at a 90-degree angle, wherein the first rod is adapted to receive a second roll of tissue paper;

f. a second rod extending from the second mounting arm at a 90 degree angle, wherein the second rod is adapted to receive a third roll of tissue paper; and g. a third rod in between the first mounting arm and second mounting arm, where the third rod is parallel and aligned with the first rod and second rod, wherein the third rod is adapted to receive a fourth roll of tissue paper.

2. The multiple roll toilet tissue holder according to claim 1, where a magnetic portion lies at the center of the third rod.

3. The multiple roll toilet tissue holder according to claim 2, wherein the magnetic portion enables a division of the third rod and tissue holder into two halves.

4. The multiple roll toilet holder according to claim 1, where the first rod and second rod are curved.

5. The multiple roll toilet holder according to claim 1, further including a back plate.

6. The multiple roll toilet holder according to claim 5, where the back plate includes a face plate.

7. The multiple roll toilet holder according to claim 5, where the back plate includes two openings, where the openings allow for the insertion of the first mounting arm and second mounting arm.

* * * * *